United States Patent [19]

Suga

[11] 3,991,336

[45] Nov. 9, 1976

[54] XENON LAMP HAVING MAGNETS AROUND THE ELECTRODES THEREOF

[76] Inventor: Shigeru Suga, Yoyogi 5-20-2, Shibuya, Tokyo, Japan

[22] Filed: Oct. 31, 1975

[21] Appl. No.: 627,881

[52] U.S. Cl. ..... 313/156; 313/161

[51] Int. Cl.[2] ..... H01J 1/50

[58] Field of Search ..... 313/156, 161

[56] References Cited

UNITED STATES PATENTS 3,113,234 12/1963 Schlegel ..... 313/161 X

*Primary Examiner*—James B. Mullins
*Assistant Examiner*—Darwin R. Hostetter
*Attorney, Agent, or Firm*—Wenderoth, Lind & Ponack

[57] ABSTRACT

A xenon lamp equipped with magnets attached to the outside of the tube of the xenon lamp at the positions of the electrodes so that metal vapor and other volatile matter emitted from the electrodes at the time of glow discharge is attracted onto the inner wall of the tube at the positions of magnets due to the magnetic field of the magnets, whereby blackening and white turbidity on the light-transmitting part of the wall of the xenon lamp are avoided.

2 Claims, 6 Drawing Figures

XENON LAMP HAVING MAGNETS AROUND THE ELECTRODES THEREOF

The present invention relates to a xenon lamp having magnets attached to the outside of the tube at the positions of the electrodes to prevent blackening and white turbidity that will otherwise occur on the inner wall of the tube at the light-emitting portion of the lamp. With the lamp of this invention, the quantity of light emitted by the lamp is not reduced, i.e. a constant quantity of emitted light is maintained even after long periods of use.

BACKGROUND AND PRIOR ART

Conventional xenon lamps, in general, consist of the electrodes made of materials such as thorium and tungsten, sealed in both ends of a quartz glass tube, and a xenon gas confined in the tube. The electrodes are connected to an electric circuit to produce light upon discharge of current through the xenon.

The electrodes are heated by the discharge of the current. Especially the tips of the electrodes are heated to a high temperature, and the metals of the electrodes are evaporated, although in very small amounts, and are condensed and adhered onto the entire wall of the tube, giving rise to the phenomenon known as blackening. Furthermore, volatile matter contained in the electrodes is emitted, which is a cause of white turbidity. It is common with such lamps that the quantity of light is reduced by about 10% after 100 hours of burning. Therefore, the conventional xenon lamps are very unsatisfactory as a source of light for use, for example, in light fastness testing machines and various optical measuring instruments which require a stable or constant quantity of light.

OBJECT OF THE INVENTION

The object of the present invention, therefore, is to provide a xenon lamp which eliminates the aforementioned deficiencies of the earlier xenon lamps, namely the occurrence of blackening and white turbidity.

BRIEF DESCRIPTION OF THE DRAWINGS

An embodiment of the present invention is illustrated below with reference to the accompanying drawings, in which.

DETAILED DESCRIPTION OF THE INVENTION

Figure 1:
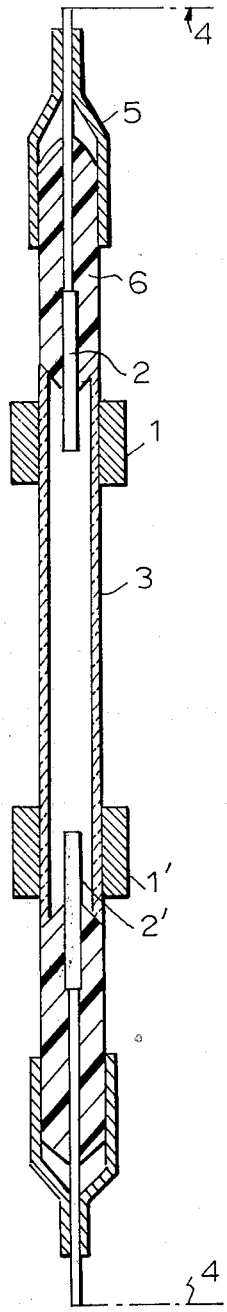
FIG. 1 is a sectional view of a xenon lamp according to the present invention.
Figure 3:
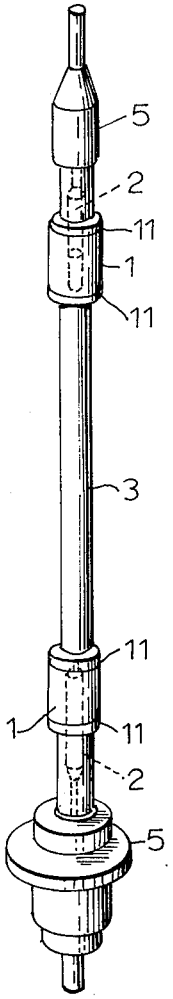
FIG. 3 is a perspective view of a xenon lamp according to the present invention.

Referring to FIGS. 1 and 3 attached to the outside of a quartz glass tube 3 of a xenon lamp at positions around the free end of the discharge electrodes 2 and 2' are annular magnets 1 and 1'. The electrodes 2 and 2' are each connected to the external electric circuit via a seal 6, metal fitting 5 and a lead wire 4.

In the lamp according to the present invention, metal ions and volatile matter emitted from the electrodes 2 and 2' are gathered on the inner wall of the tube at the positions of magnets 1 and 1' due to the force created in the tube 3 near the electrodes by the current of discharge across the upper and lower electrodes 2 and 2' and the magnetic fields of the magnets 1 and 1', whereby metal ions and volatile matter are prevented from being deposited on other parts of the tube wall.

Figure 2:
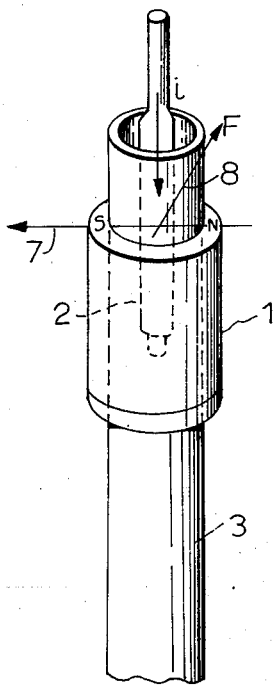
FIG. 2 is a diagram for explaining the function of the magnet of the xenon lamp according to the invention.

The action of the magnets is shown in FIG. 2, which only shows the magnet 1. The magnet 1 has a cylindrical shape, and the N and S poles are on diametrically opposite sides thereof. The reference numeral 3 designates the tube wall of the lamp, and the reference numeral 2 designates the electrode.

If current is discharged through the lamp, the current of the lamp flows in the direction indicated by *i* in FIG. 2. At this moment, however, the direction of magnetic field 7 is at right angles to the direction of the discharge current, giving rise to the force F in the direction 8 according to Fleming's left-hand rule. In effect, the metals evaporated and ionized from the electrode 2 is subjected to the thus created force. Metal ions are deprived of their free motion, and are confined in certain areas and are cooled upon contact with the wall of the tube 3 and adhere thereto. The portions to which metal ions will adhere are limited to the area near the electrodes. Metal ions will not adhere onto the tube walls where light is produced in the tube 3.

Figure 5:
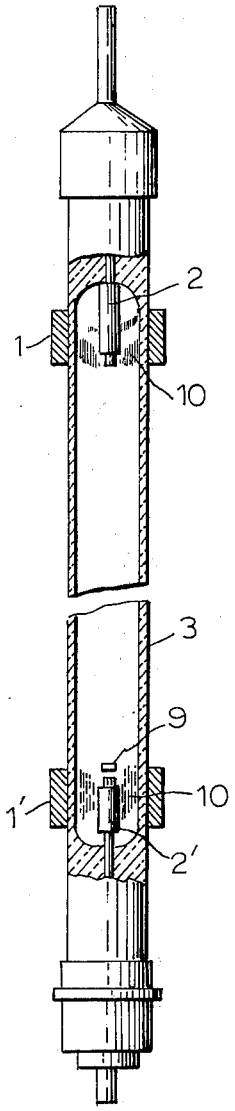
FIG. 5 is a partial sectional view showing how contamination occurs on the tube wall of a xenon lamp according to the present invention.

FIG. 5 shows the way in which the material evaporated from the electrodes 2 and 2' adheres to the tube 3 only around the magnets 1 and 1'. Referring to FIG. 5, the blackening is formed at 10 on the tube wall 3 only around the electrodes 2 and 2'. White turbidity is formed at the same location only very slightly.

Figure 4:
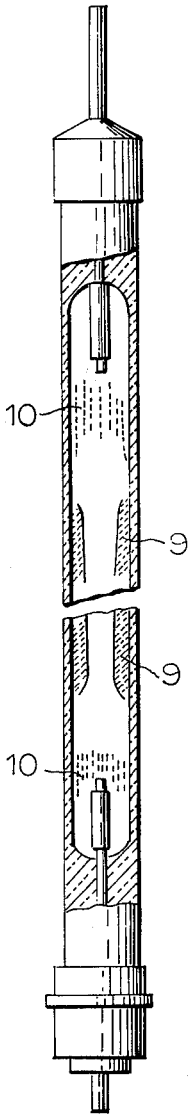
(PRIOR ART) FIG.4
FIG. 4 is a partial sectional view showing how contamination occurs on the tube wall of conventional xenon lamps.

On the contrary, in a conventional xenon lamp shown in FIG. 4, the area of blackening 10 spreads from the areas around the free end of the electrodes toward the central area of the tube over a distance of several centimeters, and white turbidity 9 is formed at the central portion of the tube.

Figure 6:
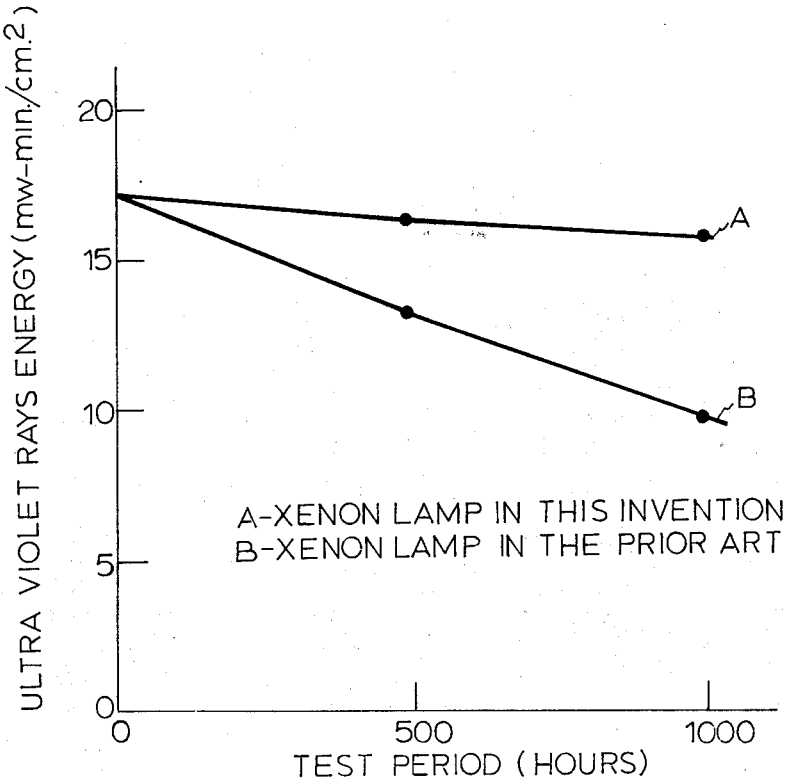
FIG. 6 is a graph showing the reduction in the quantity of light for conventional xenon lamps compared with the xenon lamp according to the present invention.

As described above, the xenon lamp of the present invention produces a constant quantity of light (ultraviolet ray energy) even after long periods of use. Results of the testing showed a reduction of light quantity of less than 10% after 1000 hours of burning, which is a very large increase in efficiency as compared with the conventional xenon lamps in which the light quantity is reduced about 40% after 1000 hours of burning, as shown in FIG. 6.

The magnets can be attached to the outside of the xenon lamp tube in a variety of ways. Among them, the simplest method is shown in FIG. 3, in which pairs of spaced rings 11 are used to fasten the magnets 1 and 1' to the tube 3. The rings 11 are made of a resilient material so that they are tightly engaged around the tube 3 and hold the magnets to the wall of tube 3 between them.

According to the present invention, the xenon lamp is manufactured by sealing the electrodes 2 and 2' into the ends of the quartz glass tube 3 and then introducing a xenon gas thereinto. The magnets 1 and 1' are then placed on the tube, and the positions thereof are adjusted, and then they are firmly secured by placing the rings 11 on the tube. Then the metal fittings 5 are connected to both ends of the electrodes 2 and 2' and attached to the quartz glass tube 3 of the lamp.

What is claimed is:

1. A xenon lamp comprising:

an elongated tube of quartz;

electrodes sealed in the opposite ends of said tube;

xenon gas filling said tube; and an annular magnet around the tube at the position corresponding to the free end of each electrode, whereby metal vapor and other volatile material given off by the electrodes at the time of glow discharge is attracted onto the inner surface of the tube at the positions of the magnets and blackening and white turbidity on the light transmitting part of the wall of the tube are avoided.

2. A xenon lamp as claimed in claim 1 further comprising rings of resilient material tightly secured around the tube at the opposite ends of each magnet for holding the magnets in position on said tube.

* * * * *